US010999672B2

(12) United States Patent
Shen et al.

(10) Patent No.: US 10,999,672 B2
(45) Date of Patent: May 4, 2021

(54) ACOUSTIC CHAMBERS TO IMPROVE SOUND REPRODUCTION BETWEEN LEFT AND RIGHT EARCUPS

(71) Applicant: Kingston Technology Corporation, Fountain Valley, CA (US)

(72) Inventors: Kai Lin Shen, Taipei (TW); Peter Leekuo Chou, Brea, CA (US); Chia-Hsiang Chang, Taichung (TW)

(73) Assignee: Kingston Technology Corporation, Fountain Valley, CA (US)

( * ) Notice: Subject to any disclaimer, the term of this patent is extended or adjusted under 35 U.S.C. 154(b) by 0 days.

(21) Appl. No.: 16/596,536

(22) Filed: Oct. 8, 2019

(65) Prior Publication Data

US 2021/0105555 A1 Apr. 8, 2021

(51) Int. Cl.

| | |
|---|---|
| ***H04R 1/10*** | (2006.01) |
| ***H04R 1/24*** | (2006.01) |
| ***H04R 1/28*** | (2006.01) |

(52) U.S. Cl.

CPC ..... *H04R 1/24* (2013.01); *H04R 1/1008* (2013.01); *H04R 1/2823* (2013.01)

(58) Field of Classification Search

CPC ... H04R 1/1008; H04R 1/2826; H04R 1/2888

USPC ..... 381/371

See application file for complete search history.

(56) References Cited

U.S. PATENT DOCUMENTS

| | | | | |
|---|---|---|---|---|
| 4,302,635 | A * | 11/1981 | Jacobsen | H04R 1/1058 381/371 |
| 7,564,988 | B2 * | 7/2009 | Azima | H04R 1/1075 381/326 |
| 8,111,858 | B2 * | 2/2012 | Sapiejewski | H04R 1/1083 381/372 |
| 9,942,648 | B2 | 4/2018 | Azmi | |
| 10,034,112 | B2 * | 7/2018 | Price | H04R 1/2823 |
| 10,484,772 | B2 * | 11/2019 | Barrieau | H04R 1/1008 |
| 2009/0232340 | A1 * | 9/2009 | Yang | H04R 1/2811 381/371 |
| 2009/0268935 | A1 * | 10/2009 | Dillinger | H04R 1/1075 381/371 |

(Continued)

OTHER PUBLICATIONS

Hifiman Electronics; hifiman.com; Hifiman HE1000 Planar Magnetic Headphone; Hifiman HE1000 Owner's Guide; copyright 2007-2018.

*Primary Examiner* — Ryan Robinson
(74) *Attorney, Agent, or Firm* — Lynch LLP

(57) ABSTRACT

This application is directed to acoustic chambers that can be incorporated into headsets to improve consistency of sound reproduction between a left and right earcup. Headsets, especially wireless headsets, need to hold many different components within the earcups (e.g., batteries, wireless components, etc.). As earcups are required to hold more components, imbalances between left and right can result. For example, a left earcup might hold a battery, while a right earcup holds wireless charging components. Differences between left and right components can ultimately result in sound reproduction inconsistencies between left and right earcups. Embodiments of the inventive subject matter create consistent acoustic chambers for both left and right earcups so that sound reproduction between the earcups is unaffected by components housed within each earcup.

15 Claims, 4 Drawing Sheets

(56) References Cited

U.S. PATENT DOCUMENTS

2018/0316999 A1* 11/2018 Bellas ..... H04R 1/1008
2020/0000639 A1* 1/2020 Almeflo ..... A61F 11/14

* cited by examiner

ACOUSTIC CHAMBERS TO IMPROVE SOUND REPRODUCTION BETWEEN LEFT AND RIGHT EARCUPS

FIELD OF THE INVENTION

The field of the invention is sound reproduction in headsets.

BACKGROUND

The background description includes information that may be useful in understanding the present invention. It is not an admission that any of the information provided in this application is prior art or relevant to the presently claimed invention, or that any publication specifically or implicitly referenced is prior art.

Headsets are becoming increasingly complex pieces of electronic equipment. Modern headsets can include surround sound, noise cancellation, wireless charging, wireless circuitry, batteries, etc. Headset earcups can be filled with components to make these different features possible, which can result in asymmetries between the earcups of a headset. For example, a headset capable of wireless charging can include a battery in a left earcup with associated wireless charging hardware in the right earcup. Components are typically distributed between left and right earcups so that weight distribution between each earcup is balanced, but this can result in earcups having asymmetric internal configurations, which can create inconsistent sound reproduction between left and right earcups despite identical sound reproduction components.

Asymmetric sound reproduction can, in some cases, be corrected by signal processing. For example, when the frequency response of a left earcup indicates that a certain frequency range is depressed compared to a right earcup, signal processing techniques can be implemented to bring the two earcups to parity. But correcting these issues via signal processing can be overly burdensome, requiring unique signal processing solutions for every headset. It would be preferable to have a one-size-fits-all solution that does not require implementation of signal processing correction. Such a solution would ideally be mechanical in nature (i.e., not requiring any additional electronics or specialized software).

Some mechanical solutions exist, such as those demonstrated in the HIFIMAN HE1000, which includes an almost-fully open earcup outer covering. But to include an entirely open back requires sacrifices that render such a solution incompatible with many different features that users often look for. For example, with an open back, there can be no internal components inside the earcup in between the sound driver and the open back. This creates serious design constraints that can prevent incorporation of features such as wireless connections and wireless charging.

Headsets having some volume of space behind a sound driver have been contemplated before, as demonstrated in U.S. Pat. No. 9,942,648 to Azmi et al. But Azmi et al. discloses a chamber behind a sound driver in an earbud, the chamber must be formed as a part of the earbud, and it does not create additional space for other internal components.

Thus, there remains a need in the art for a mechanical solution to the asymmetry problem created when headsets incorporate a wide variety of features requiring internal earcup space.

SUMMARY OF THE INVENTION

The present invention provides apparatuses, systems, and methods directed to acoustic chambers that improve sound reproduction between left and right earcups in headsets.

In one aspect of the inventive subject matter, a device to make sound reproduction consistent across earcups in a headset comprises: an acoustic chamber configured to be incorporated into the interior of an earcup, where the acoustic chamber is sized and dimensioned to at least partially enclose a sound driver within the earcup; at least one vent that allows for pressure waves generated by the sound driver to exit the acoustic chamber, wherein the at least one vent extends from a surface of the acoustic chamber, where the at least one vent has a vent (e.g., a hollow stem) so that pressure waves exiting the acoustic chamber pass into ambient air outside the earcup.

In some embodiments, acoustic chambers can include plastic (e.g., a plastic having a hardness between 50 and 130 on the Rockwell R scale). In some embodiments, the acoustic chamber can be shaped based on the sound driver's shape (e.g., the acoustic chamber can be rounded having similar curvature to the curvature of the sound driver). In some embodiments, the acoustic chamber includes at least one protrusion having a screw hole to facilitate affixing the acoustic chamber to the interior of an earcup so that it at least partially encloses the sound driver.

Embodiments of the inventive subject matter can be incorporated into headsets, and thus in another aspect of the inventive subject matter, a headset having improved sound reproduction consistency between a left earcup and a right earcup comprises: a first acoustic chamber incorporated into the interior of the a earcup, where the first acoustic chamber is sized and dimensioned to at least partially enclose a left sound driver within the earcup; a first vent that allows for first pressure waves generated by the left sound driver to exit the left acoustic chamber, wherein the first vent extends from a first surface of the left acoustic chamber; and wherein the first vent comprises a first duct so that the first pressure waves exiting the acoustic chamber pass into ambient air outside the left earcup; a second acoustic chamber incorporated into the interior of the right earcup, where the second acoustic chamber is sized and dimensioned to at least partially enclose a right sound driver within the earcup; a second vent that allows for second pressure waves generated by the right sound driver to exit the right acoustic chamber, where the second vent extends from a second surface of the right acoustic chamber; and where the second vent comprises a second duct so that the second pressure waves exiting the acoustic chamber pass into ambient air outside the right earcup.

In some embodiments, the first acoustic chamber is identical to the second acoustic chamber, while in some other embodiments, the first acoustic chamber is a mirror image of the second acoustic chamber. The left acoustic chamber can be shaped based on the left sound driver's shape while the right acoustic chamber can be shaped based on the right sound driver's shape. In some embodiments, the left and right acoustic chambers are connected to the interior of the left and right earcups by screws passing through protrusions extending off each of the left and right acoustic chambers.

One should appreciate that the disclosed subject matter provides many advantageous technical effects including improving consistency of sound reproduction between left and right earcups, especially when the left and right earcups do not have symmetrically arranged internal components. Various objects, features, aspects and advantages of the inventive subject matter will become more apparent from the following detailed description of preferred embodiments, along with the accompanying drawing figures in which like numerals represent like components.

DETAILED DESCRIPTION

Figure 1:
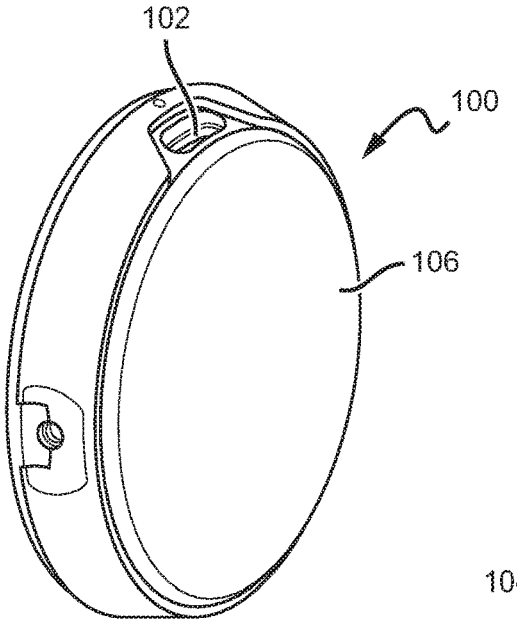
FIG. 1 shows an earcup having a vent on the top.

The following discussion provides example embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

As used in the description in this application and throughout the claims that follow, the meaning of "a," "an," and "the" includes plural reference unless the context clearly dictates otherwise. Also, as used in the description in this application, the meaning of "in" includes "in" and "on" unless the context clearly dictates otherwise.

Also, as used in this application, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

In some embodiments, the numbers expressing quantities or number ranges used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed considering the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements. Moreover, unless the context dictates the contrary, all ranges set forth in this application should be interpreted as being inclusive of their endpoints and open-ended ranges should be interpreted to include only commercially practical values. Similarly, all lists of values should be considered as inclusive of intermediate values unless the context indicates the contrary.

The inventive subject matter is directed to a vented acoustic chamber that can be incorporated into headsets to ensure consistent sound reproduction between the left ear and the right ear. As headsets develop into more and more complicated pieces of equipment, they require more internal components disposed in each earcup to enable every new feature and function that is added. For example, wireless headsets need to house one or more batteries and wireless circuitry and antennas in addition to sound reproduction elements. Some headsets may include noise cancellation components, others may include wireless charging components. To fit every necessary component into a headset, components must be placed into the two earcups, which can result in asymmetric internal configurations between the right ear and the left ear. Sound reproduction can also be impacted by the shape and size of the outer covering of an earcup.

These resulting asymmetries negatively impact sound reproduction, causing imbalances between left and right earcups. For example, sound reproduced in a right earcup can be different from sound reproduced in a left earcup despite identical sound drivers and identical signals being sent to each sound driver because the right earcup houses different components than the left earcup. Embodiments of the inventive subject matter provide a solution to these imbalances, making it possible to have precise and consistent sound reproduction between different earcups of a headset despite differing internal configurations between the earcups.

All these inconsistencies and performance-impacting factors can be addressed by embodiments of the inventive subject matter. To solve the asymmetry problem, earcups of the inventive subject matter can incorporate acoustic chambers that enclose sound drivers within those earcups. Those acoustic chambers feature one or more vents to the exterior of the earcups so that the chambers do not create back pressure that negatively impact sound reproduction.

Figure 2:
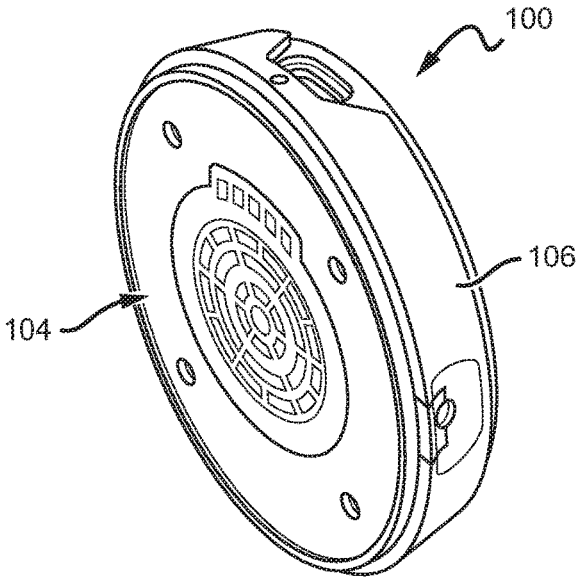
FIG. 2 shows an alternate view of the earcup in FIG. 1.

FIG. 1 shows a perspective view of an earcup 100 of the inventive subject matter having a venting feature 102 that passes through the earcup's outer covering 106. FIG. 2 shows the same earcup 100 from a different angle to show the sound-generating side 104 of the earcup 100. In a headset incorporating the inventive subject matter, the sound-generating side 104 of the earcup 100 would be directed toward a user's ear.

Figure 3:
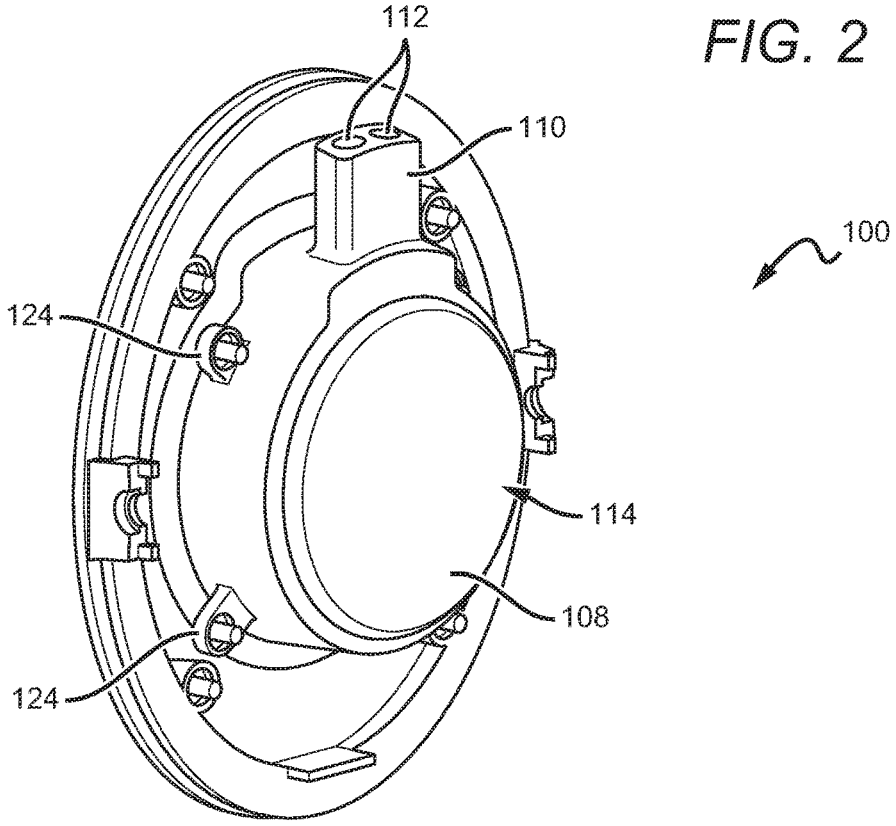
FIG. 3 shows the earcup of FIG. 1 without the outer covering.

FIG. 3 shows the earcup of FIGS. 1 & 2 without the outer covering 106. In the absence of the outer covering 106, the acoustic chamber 108 becomes visible. The acoustic chamber 108 creates a cavity in which components directly related to sound creation (e.g., one or more speaker drivers) are at least partially housed. A goal of the acoustic chamber 108 is to create a chamber into which the back side of a speaker driver causes pressure waves to propagate, which enables consistent sound reproduction across different earcups of a headset despite the different earcups housing different components and otherwise having different internal configurations.

If an acoustic chamber is sealed (e.g., unvented), then pressure waves generated from the sound driver and projected into the chamber can negatively impact speaker driver performance. If, on the other hand, no acoustic chamber is included and venting is allowed out of the earcup (e.g., because the earcup is not perfectly sealed or because the earcup outer covering has an opening), then pressure waves coming off the back of the speaker can interact with components within the earcup, thereby changing the sound generating qualities of that speaker driver. Thus, to create consistent sound reproduction, acoustic chambers with venting are preferable.

As mentioned above, when a left earcup and a right earcup from the same headset have different internal components, pressure wave interactions within the earcups can impact speaker driver performance differently between the earcups, whether they are vented or unvented. Acoustic chambers of the inventive subject matter are designed to eliminate these differences and inconsistencies. And through the addition of a chamber and vent, they also minimally impact sound reproduction and maintain consistent performance between left and right earcups.

As seen in FIG. 3, the acoustic chamber 108 includes a small, duct (e.g., a hollow stem) 110 that creates two parallel vents 112 that in turn connect to the interior of the acoustic chamber 108. In some embodiments, the duct can create only a single vent, and in still further embodiments, the duct can create more than two vents. Duct 110 can be positioned and oriented in any number of different ways. For example, the duct 110 could come off the outer surface 114 of the acoustic chamber 108 in a direction normal to that surface, or in some embodiments, the duct 110 can come off the outer surface in any other direction than is depicted in FIG. 3. In still further embodiments, multiple ducts can be included coming off the acoustic chamber in different directions, allowing for pressure waves to exit an acoustic chamber (and, in some embodiments, exit an earcup) in multiple directions. It should be understood that pressure waves are described as "exiting" an acoustic chamber due to the nature of pressure wave propagation, though pressure waves generated by a sound driver cause air to both exit and enter the acoustic chamber via the acoustic chamber's ducting. Duct 110 is configured to so what when it is installed into earcup 100, it vents out the top of the earcup, as shown in FIG. 1. This venting configuration maximizes internal space in the earcup to make room for other components. In some embodiments, an acoustic chamber of the inventive subject matter can vent into the interior of an earcup, preferably, but not necessarily, when that earcup's interior is properly vented to its exterior. In embodiments where an acoustic chamber vents into an interior of an earcup, the acoustic chamber still creates a consistent chamber around the backside of the earcup's sound driver, though sound reproduction may be affected by the earcup's venting (e.g., performance may be better in embodiments where the earcup's interior includes venting, though it is contemplated that the inventive subject matter would still be beneficial even without interior earcup venting).

Figure 7:
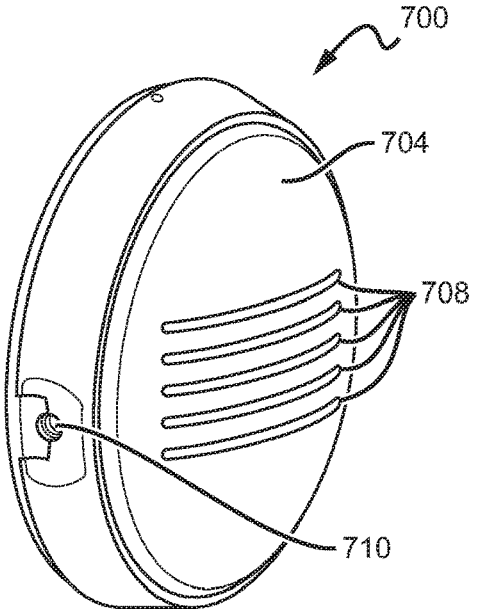
FIG. 7 shows a vented outer covering.
Figure 9:
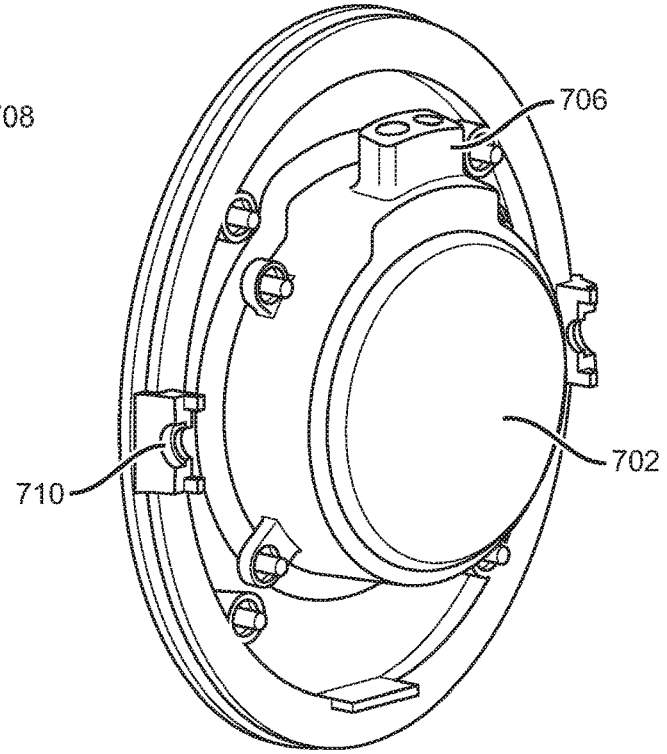
FIG. 9 shows an earcup without an outer covering and having an acoustic chamber designed to vent to the interior of an earcup.
Figure 8:
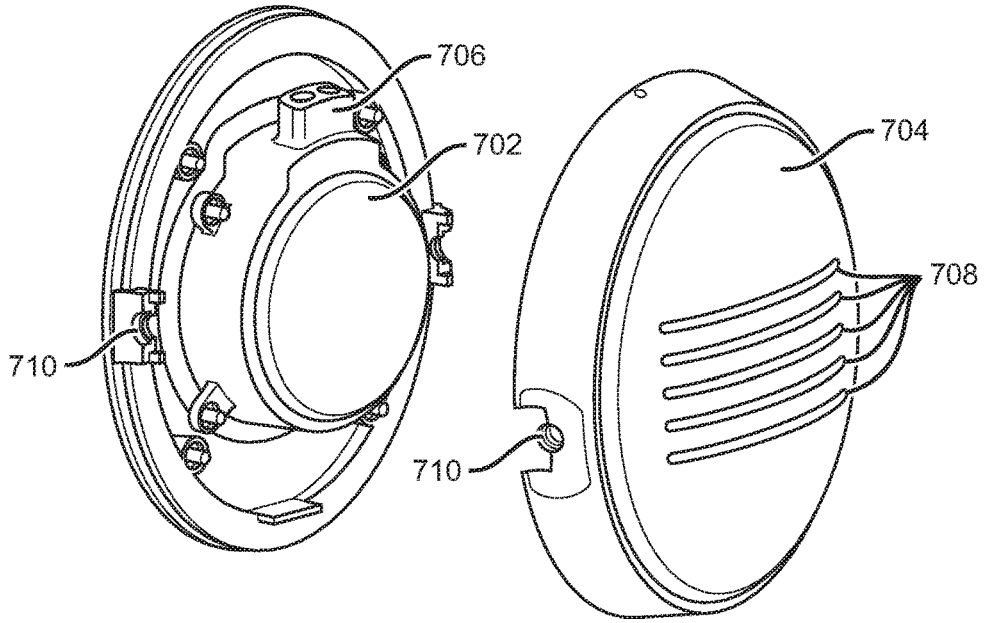
FIG. 8 shows an exploded view of an earcup having an acoustic chamber that vents to the interior of the earcup having a vented outer covering.

In some embodiments, earcups of the inventive subject matter can include an acoustic chamber that does not directly vent to the exterior of the earcup. FIGS. 7-9 show an earcup 700 having an incorporated acoustic chamber 702 that does not vent to the exterior of the earcup 700 as defined by the earcup's outer covering 704. As shown in FIG. 9, the acoustic chamber's vent 706 is not long enough to reach the exterior of the outer covering 704. In embodiments like this one, where the acoustic chamber vents to the interior of the earcup, the earcup is itself vented. As shown in FIGS. 7 and 8, the outer covering 704 includes a series of vents 708. These vents allow for the passage of air between the exterior and interior of the outer covering 704, and, thus, when the headset is in use and producing sound, pressure waves are able to exit the acoustic chamber 702 into the interior of the earcup 700 via vent 706 and subsequently exit the outer covering of the earcup 704 via vents 708. It is additionally contemplated that, in embodiments where the acoustic chamber vents to the interior of an earcup, venting from the interior of the earcup to the exterior of the earcup can be incorporated into ports (e.g., in the space around charging ports or audio ports such as a 3 mm or 5 mm connector). For example, port 710 can vent from the interior of the earcup 700 to the exterior of the earcup 700. The vented outer covering 704 shown in FIGS. 7-9 can be incorporated into any embodiment presented in this application.

Although FIGS. 7-9 show the acoustic chamber with a vent pointing upward, it is contemplated that the acoustic chamber's vent can come off the acoustic chamber in any direction and at any angle. When the acoustic chamber's vent is allowed to be reconfigured in these ways, different internal earcup configurations are facilitated, allowing engineers to add, remove, or reconfigure internal components without needing to work around an extremely rigid acoustic chamber configuration.

When headsets feature acoustic chambers of the inventive subject matter, sound reproduction is made consistent across a variety of different configurations. As discussed above, an acoustic chamber can vent into the interior of an earcup when the earcup is itself vented. In other embodiments, an acoustic chamber can vent to the exterior of an earcup's outer covering. It is additionally contemplated that some headsets can forgo inclusion of an earcup's outer covering entirely without having any material impact on sound reproduction. This is because acoustic chambers of the inventive subject matter are designed to create consistency across many different headset configurations. When acoustic chambers are included in a headset, the headset's sound drivers vent into its acoustic chambers, which are designed identically (or, in some embodiments, symmetrically) for each headset in which they are implemented.

Figure 4:
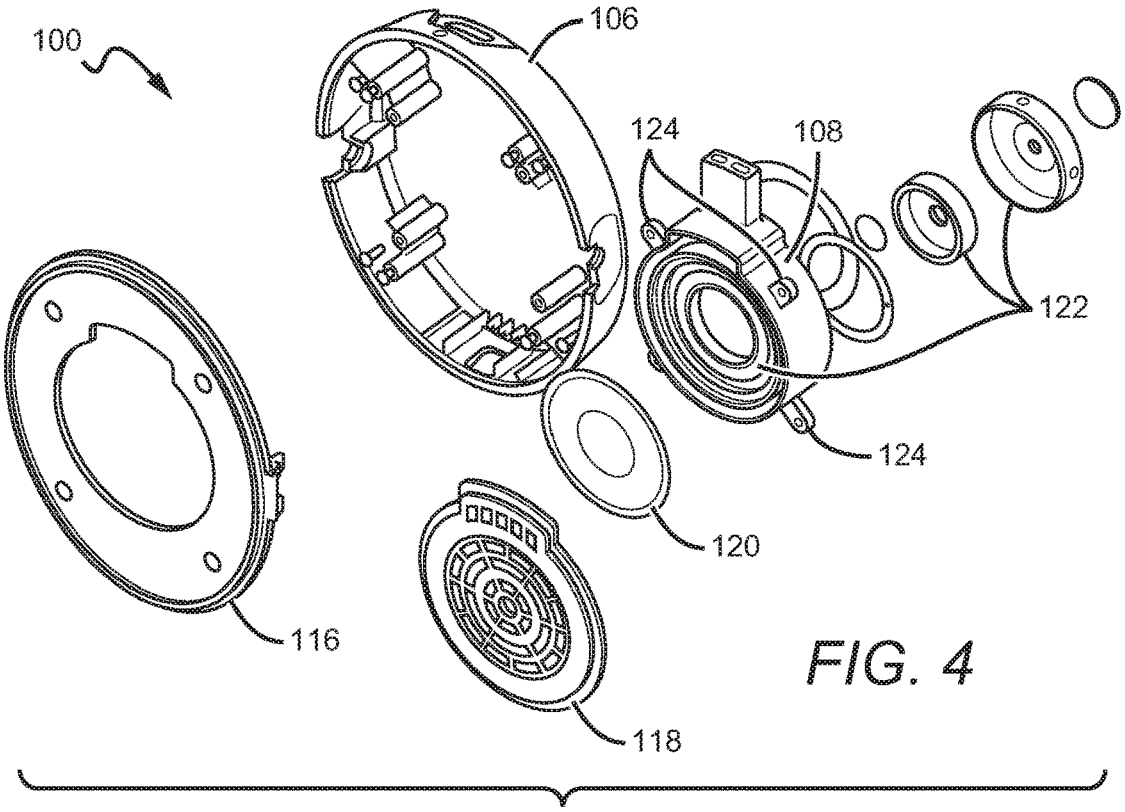
FIG. 4 shows an exploded view of the earcup of FIG. 1.

FIG. 4 shows earcup 100 in an exploded view. This view shows the outer covering 106, the two components (an outer plate 116 and an inner plate 118) making up the sound-generating side 104 of the earcup 100, the sound driver comprising a diaphragm 120 and supporting hardware 122 (e.g., driver coils, associated electronics, etc.), as well as the acoustic chamber 108. The acoustic chamber 108 is designed so that it can easily be incorporated into many different earcups. It includes a plurality of protrusions 124 that can have fastener holes. The fastener holes in these protrusions 124 can accommodate screws that fasten the acoustic chamber to the outer plate 116 of the sound-generating side of an earcup. In some embodiments, the protrusions can be used to glue an acoustic chamber in place within an earcup. In some embodiments, the outer plate 116 and inner plate 118 can be made from a single piece, and in those embodiments, the acoustic chamber would be fastened to the sound-generating side, generally. Regardless of which specific component the acoustic chamber couples with, it will perform its intended function if the back side of a sound driver projects pressure waves into the acoustic chamber for venting out of an earcup. Embodiments of the inventive subject matter can be incorporated into virtually any on-ear or over-ear headset simply and effectively.

Acoustic chambers of the inventive subject matter can take on a wide variety of different shapes and configurations. Regardless of the configuration of a specific embodiment of an acoustic chamber, the acoustic chamber used in a left earcup should be the same acoustic chamber used in a right earcup (and vice versa, and, in some embodiments, having each acoustic chamber configured as a mirror image of each other, if necessary, to maintain symmetry).

Figure 5:
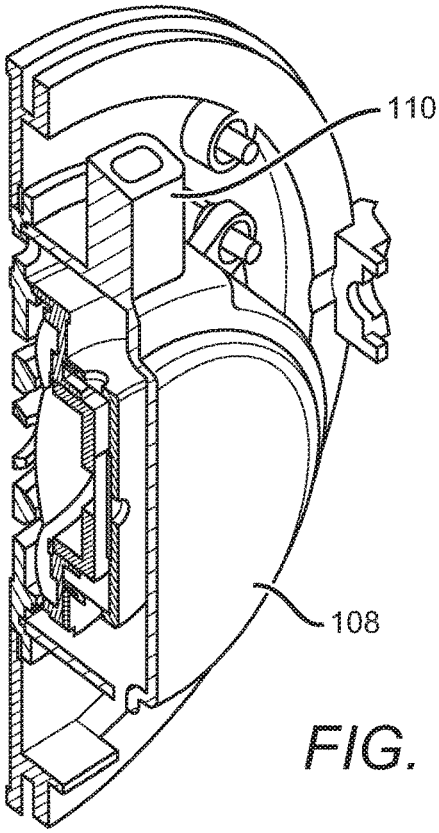
FIG. 5 shows a cutaway view of the earcup of FIG. 1.

The volume of an acoustic chamber can be changed or adjusted as needed, but an acoustic chamber of the inventive subject matter is sized and dimensioned to occupy as little space within an earcup as necessary. This reserves space within the earcup for other internal components. FIG. 5 shows a cutaway view of the acoustic chamber 108 shown in FIGS. 1-4. The acoustic chamber 108 is formed so there is some distance between each of the sound generating components and the chamber itself without coming into physical contact with any of those components that could otherwise cause sound reproduction issues. Thus, the acoustic chamber shown in the figures, when incorporated into an earcup, creates a volume of space containing the sound-generating components of the earcup within the earcup. For improved audio quality, acoustic chamber shape can be guided, at least in part, by the shape of the sound generating components contained therein. For example, the acoustic chamber can imitate the shape of the sound driver(s) within, as with a largely circular acoustic chamber for circular sound drivers as shown in the Figures. Other shapes may similarly accommodate multiple sound drivers or differently shaped sound drivers.

Acoustic chambers of the inventive subject matter can be made from a wide variety of materials. Material selection is guided, in part, by material properties such as hardness. Hardness of a material can impact performance, and performance impact is balanced with cost of materials, etc. Thus, plastics (e.g., acrylonitrile butadiene styrene (ABS) and polycarbonate-ABS) are generally preferable. For example, plastics having hardness ratings between 50 and 130 on the Rockwell R scale are suitable.

Figure 6:
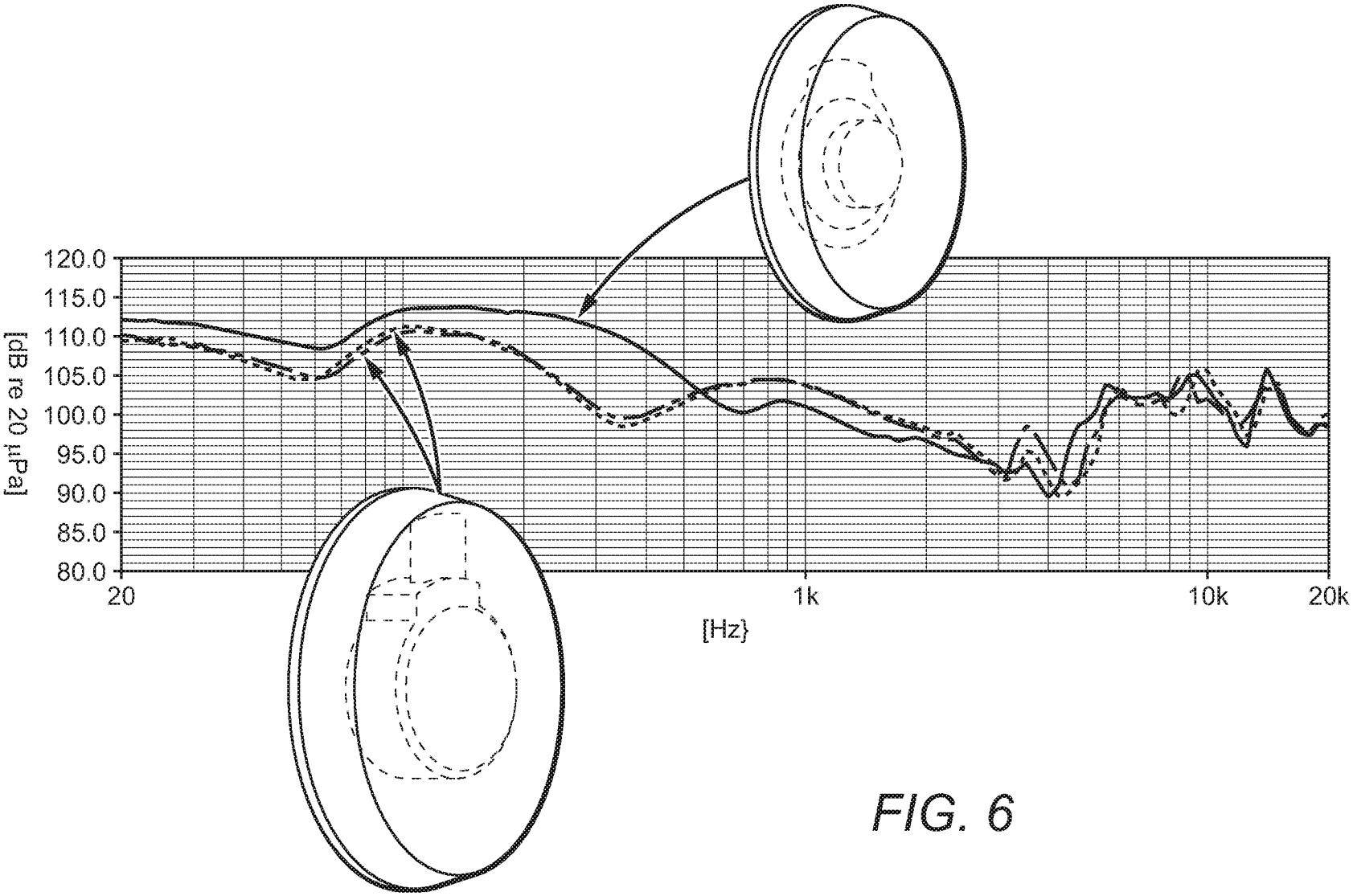
FIG. 6 shows a frequency response graph for two earcups having acoustic chambers of the inventive subject matter and one earcup without.

Improvements are in sound reproduction as well as reproduction consistency are apparent in headsets featuring acoustic chambers of the inventive subject matter. For example, FIG. 6 shows a graph of frequency responses for earcups both with and without an acoustic chamber where the x-axis is frequency in Hz and the y-axis is loudness in dB re 20 μPa. Beginning at 20 Hz on the x-axis, the bottom two lines indicate frequency response of two earcups with incorporated acoustic chambers, and the top line indicates frequency response of an earcup without an incorporated acoustic chamber. Notably, both earcups with incorporated acoustic chambers perform nearly identically to each other across all frequencies tested.

As described in this application, one benefit of the present invention is that additional sound optimization processes, such as digital signal processing tailored to improve the quality of sound within a headset, can be tailored instead to be specific to the acoustic chamber of the present invention, which can in turn be incorporated into many different headsets. Thus, the present invention improves the cost of research and development for the creation of new headsets or other devices incorporating a sound driver.

Thus, specific systems and methods directed to improving consistent sound reproduction across left and right earcups have been disclosed. It should be apparent, however, to those skilled in the art that many more modifications besides those already described are possible without departing from the inventive concepts in this application. The inventive subject matter, therefore, is not to be restricted except in the spirit of the disclosure. Moreover, in interpreting the disclosure all terms should be interpreted in the broadest possible manner consistent with the context. In particular the terms "comprises" and "comprising" should be interpreted as referring to the elements, components, or steps in a non-exclusive manner, indicating that the referenced elements, components, or steps can be present, or utilized, or combined with other elements, components, or steps that are not expressly referenced.

What is claimed is:

1. A headset audio device, comprising:

an earcup comprising a sound driver assembly and an outer covering;

wherein the outer covering is configured to couple with the sound driver assembly to create an internal cavity;

wherein the sound driver assembly comprises an acoustic chamber that is disposed in the internal cavity, wherein the acoustic chamber is sized and dimensioned to at least partially enclose the sound driver assembly;

at least one acoustic chamber vent that allows for pressure waves generated by the sound driver assembly to exit the acoustic chamber;

wherein the at least one vent is configured as a hollow stem extending from the acoustic chamber; and whereby pressure waves exiting the acoustic chamber exit the acoustic chamber via the vent into the internal cavity.

2. The device of claim 1, wherein the acoustic chamber comprises a plastic.

3. The device of claim 2, wherein the plastic has a hardness between 50 and 130 on the Rockwell R scale.

4. The device of claim 1, wherein a shape of the acoustic chamber imitates the sound driver assembly's shape.

5. The device of claim 1, wherein the acoustic chamber comprises at least one protrusion having a screw hole to facilitate affixing the acoustic chamber to the interior of an earcup.

6. The device of claim 1, wherein the outer covering comprises at least one outer covering vent.

7. A headset having improved sound reproduction consistency between a left earcup and a right earcup, comprising:

the left earcup comprising a left sound driver assembly and a left outer covering;

wherein the left outer covering is configured to couple with the left sound driver assembly to create a left internal cavity;

wherein the left sound driver assembly comprises a left acoustic chamber that is disposed in the left internal cavity, wherein the left acoustic chamber is sized and dimensioned to at least partially enclose the left sound driver assembly;

at least one left acoustic chamber vent that allows for pressure waves generated by the left sound driver to exit the left acoustic chamber, wherein the at least one left acoustic chamber vent extends from a surface of the left acoustic chamber; and wherein the at least one left acoustic chamber vent is configured as a hollow stem, and whereby pressure waves exit the left acoustic chamber via the left vent into the left internal cavity;

the right earcup comprising a right sound driver assembly and a right outer covering;

wherein the right outer covering is configured to couple with the right sound driver assembly to create a right internal cavity;

wherein the right sound driver assembly comprises a right acoustic chamber that is disposed in the right internal cavity, wherein the right acoustic chamber is sized and dimensioned to at least partially enclose the right sound driver assembly;

at least one right acoustic chamber vent that allows for pressure waves generated by the right sound driver to exit the right acoustic chamber, wherein the at least one right acoustic chamber vent extends from a surface of the right acoustic chamber; and wherein the at least one right acoustic chamber vent is configured as a second hollow stem, and whereby pressure waves exit the right acoustic chamber via the right vent into the right internal cavity.

8. The headset of claim 7, wherein the left acoustic chamber is the same shape as the right acoustic chamber.

9. The headset of claim 7, wherein the left acoustic chamber is a mirror image of the right acoustic chamber.

10. The headset of claim 7, wherein the left and right acoustic chambers comprise a plastic.

11. The headset of claim 10, wherein the plastic has a hardness between 50 and 130 on the Rockwell R scale.

12. The headset of claim 7, wherein the left acoustic chamber's shape imitates the left sound driver assembly's shape and the right acoustic chamber's shape imitates the right sound driver assembly's shape.

13. The headset of claim 7, wherein the left acoustic chamber comprises at least one protrusion having a screw hole to facilitate affixing the left acoustic chamber to the interior of the left earcup.

14. The headset of claim 7, wherein the right and left earcups comprise venting.

15. The headset of claim 7, wherein the left outer covering comprises at least a left outer covering vent and the right outer covering comprises at least a right outer covering vent.

* * * * *